United States Patent [19]

Chambers

[11] Patent Number: 4,928,977

[45] Date of Patent: May 29, 1990

[54] THROWN AND BOUNCED TOY HAVING A HAND GRIP TERMINATING IN HIGH BOUNCE BALLS

[76] Inventor: Timothy D. Chambers, P.O. Box 668, Gold Bar, Wash. 98251

[21] Appl. No.: 295,431

[22] Filed: Jan. 9, 1989

[51] Int. Cl.[5] ..... A63B 65/00

[52] U.S. Cl. ..... 273/428; 273/58 C

[58] Field of Search ..... 273/428, 58 C

[56] References Cited

U.S. PATENT DOCUMENTS

| | | | |
|---|---|---|---|
| 1,385,642 | 7/1921 | Restein | 273/428 X |
| 2,002,631 | 5/1935 | Fiondella | 273/428 |
| 2,377,498 | 6/1945 | Jacke | 273/428 |
| 2,826,861 | 3/1958 | Hoffstadt | 273/428 X |
| 3,069,804 | 12/1962 | Cirafesi | 273/428 X |
| 3,114,550 | 12/1963 | Hughes | 273/428 |
| 3,241,834 | 3/1966 | Stingley | 273/58 J |
| 3,452,986 | 7/1969 | Behrendsen | 273/58 J |
| 4,155,552 | 5/1979 | Jacobo et al. | 273/428 X |
| 4,253,673 | 3/1981 | Bailey | 273/428 |
| 4,266,781 | 5/1981 | Blue | 273/428 X |
| 4,309,038 | 1/1985 | Spoon | 273/428 |
| 4,346,902 | 8/1982 | Warehime | 273/411 |

FOREIGN PATENT DOCUMENTS

| | | | |
|---|---|---|---|
| 1592059 | 7/1981 | United Kingdom | 273/428 |
| 2080122 | 2/1982 | United Kingdom | 273/428 |

*Primary Examiner*—Paul E. Shapiro

*Attorney, Agent, or Firm*—Roy E. Mattern, Jr.

[57] ABSTRACT

A toy for throwing, bouncing, and catching has a cylindrical padded hand gripped rod, which extends at each end to and partially into respective high bounce balls. The balls each have a cylindrical recess with a respective clearance tapered entry, formed from a previous spherical portion of a high bounce ball, or so directly formed upon molding the initial form of the respective high bounce ball. Such clearance tapered entry of each high bounce ball improves the recovery of each ball during and after being impacted under striking load conditions, and thereby improves the longevity of the high bounce balls and the overall toy. A padded sleeve conforming to the hand gripped cylindrical rod has tapered ends to also provide clearances, where the padded hand gripped rod meets the high bounce balls, to likewise improve the longevity of the overall toy.

7 Claims, 1 Drawing Sheet

FIG.1
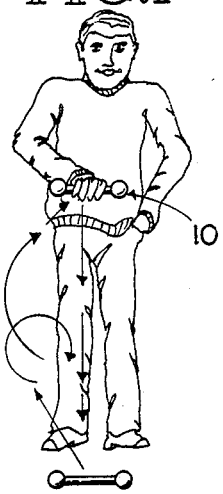
FIG.2
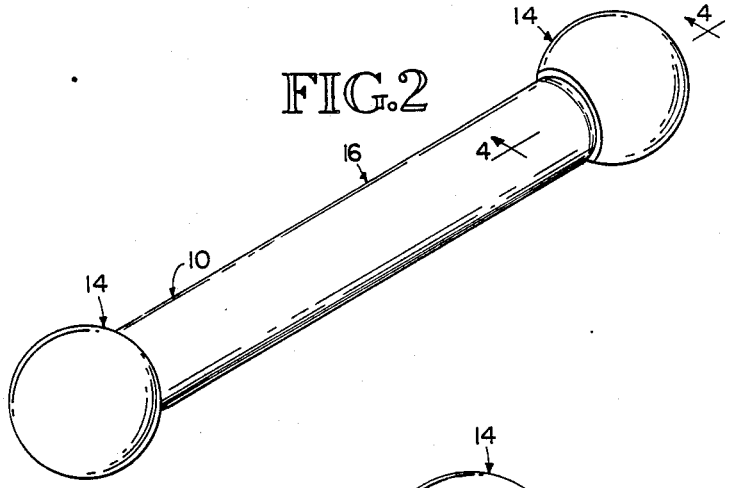
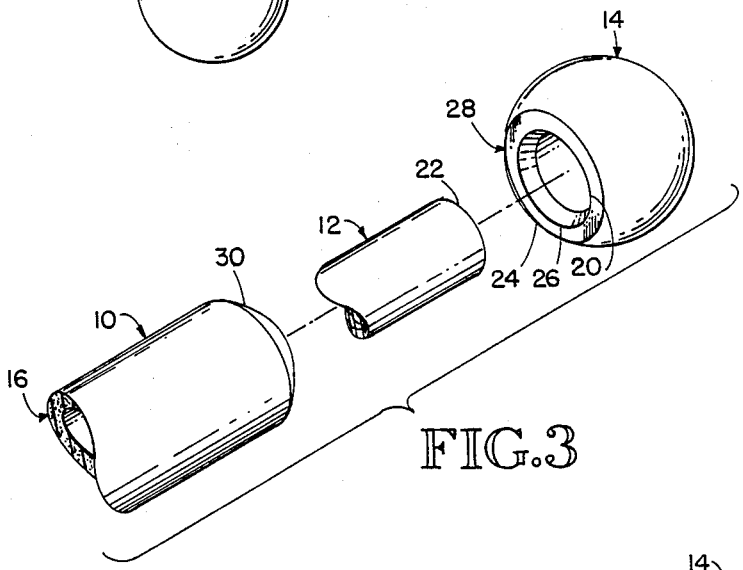
FIG.3
FIG.4
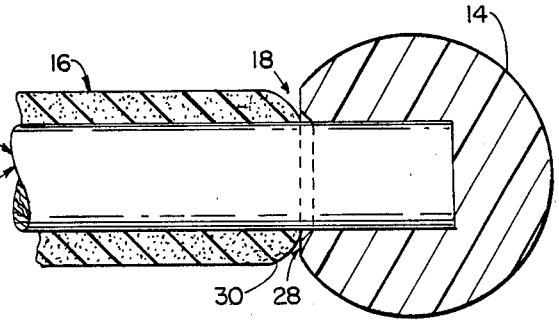

THROWN AND BOUNCED TOY HAVING A HAND GRIP TERMINATING IN HIGH BOUNCE BALLS

BACKGROUND

There have been previous toys for throwing, bouncing, and catching which have balls on the respective ends of a shaft, wand, stick, rod, or hand grip.

In U.S. Pat. No. 1,385,642 of 1921, Louise K. Restein illustrated and described her "Game or Toy" consisting of a stick, shaft, or wand, equipped at each end with a rubber ball, or otherwise provided with resilient ends. Her game or toy provided amusement, sport, exercise, and training for the hand and eye in feats of agility and skill. She provided a simple, comparatively inexpensive, and safe toy, which she designated a stunt-stick by reason of the gyrations and movements of the toy and player. She provided a stick of wood with rubber balls fitting over the ends of the stick, with both the stick ends and the recesses of the balls being complementary formed to fit one another.

In U.S. Pat. No. 3,069,804 of 1962, James C. Cirafesi illustrated and described his "Cartwheeling Stick" consisting of a stick having resilient reactionary tread members on its respective ends. When released, after being twirled in a vertical or near vertical plane on a medial transverse spin axis, the stick cartwheeled in a predetermined course along the ground. The shaft or stick was made from a light plastic tube and the tread members were comparatively heavy thick walled rubber balls.

In U.S. Pat. No. 3,114,550 of 1963, Hugh F. Hughes ill and described his "recreational bounce type device" which he called a bounce or rebound device, characterized by an orbital motion of one sphere relative to another sphere. Rubber balls of different diameters were mounted on a rod or shaft. When the toy was thrown an orbital action was created, simulating a satellite moving about an earth. Both children and adults were offered an intriguing action and a mild relaxing form of exercise.

SUMMARY

Continuing on with the provision of a similar toy for throwing, bouncing and catching, an improved toy, having a cushioned hand grip provided around a cylindrical rod and having high bounce modified balls secured about the extended ends of the cylindrical rod, is provided to children and/or adults for their use during a fun sporting time. The high bounce modified balls are specially formed to provide clearances where the cylindrical rod enters the respective balls. Such clearances extend the longevity of the toy by permitting the unrestricted flexure of portions of the balls at these locales, when the toy is impacting a hard surface such as pavement, a walkway, and/or a wall. Similar purpose clearances at this same locale are provided by specially forming the ends of the padded sleeve of the cushioned hand grip.

DRAWINGS

A preferred embodiment of the thrown, caught, and bounced toy having a hand grip terminating in modified high bounce balls is illustrated in the drawings, wherein:

FIG. 1 is a perspective view of a person throwing the toy in one of the many ways the toy may be thrown;

FIG. 2 is a perspective view of the toy;

FIG. 3 is a partial perspective exploded view of portions of the toy before their assembly to indicate the clearances provided upon the initial forming of the high bounce balls and the padded sleeve of the cushioned hand grip, where they meet one another upon their assembly on and about the hand gripped cylindrical rod; and FIG. 4 is a partial sectional view, taken along the section line 4—4 of FIG. 2, showing the assembled toy at this locale where clearances are provided to permit the necessary expansive flexure of portions of the modified high bounce balls during the impacting of the toy upon striking a hard surface.

DESCRIPTION OF THE PREFERRED EMBODIMENT

The preferred embodiment 10 of the thrown, caught, and bounced toy 10 is illustrated throughout the drawings in FIGS. 1 through 4. In FIG. 1, a person is shown throwing the toy in one of the many ways the toy may be thrown. Motion arrows indicate the travel of the toy 10. The overall appearance of the toy 10 is shown in FIG. 2.

The specific way in which the toy 10 is made is illustrated in FIGS. 3 and 4. A cylindrical rod 12, made for example from fir wood doweling material, is made of a diameter and length to be conveniently gripped by at least one hand of a person, and to extend into the interior of specially formed high bounce balls 14. These balls 14, are made, for example, from compressed and heated synthetic rubber.

To increase the hand gripping capability, a padded sleeve 16 is formed to closely fit about the portions of the cylindrical rod 12, extending between the high bounce balls 14. This sleeve 16 is made for example, from extruded foamed "Nitrile" P.V.C., i.e. a polyvinyl chloride material. These components, i.e. the rod 12, the balls 14, and the sleeve 16 are all secured together by using, for example, a polyurethane glue.

To increase the longevity of the active use of this toy, clearances are provided at the junctures 18 of the high bounce balls 14, the padded gripping sleeve 16, and the hand gripped cylindrical rod 12, as shown in FIGS. 3 and 4. In respect to the high bounce balls 14, they are modified, either by cutting away a portion, or not forming such portion at the outset when molding them, to not only create the receiving cavity 20 to fit over the ends 22 of the rod 12, but also both the radial circumferential surface 24, and the interior inwardly tapered surface 26.

The resulting overall entry profile 28 of each high bounce ball 14 serves as the basis for providing some of the clearances at the juncture 18, into which impact distorted portions of the high bounce balls 14 freely move, to avoid their otherwise fatigue stressing, and thereby prolong their effective operating game life, as this toy 10 is effectively used upon bouncing off of hard surfaces. The other clearances at the juncture 18 are provided by forming, on a radius, the ends 30 of the padded gripping sleeve 16.

As so made, this toy 10, for throwing, bouncing, and catching, serves players very well for an extended overall playing time. The players manipulate the toy in many ways. For example:

To begin, hold middle of this toy 10, and then drop it from chest height to floor, and it bounces back for easy catching;

Hold one end of this toy 10, pointing opposite end toward floor and then release it with a downward motion, and the toy 10 will bounce back for catching on end;

Stand five to six feet from a wall and then throw and release the toy 10 at an angle toward the floor, aiming at spot halfway to the wall, and the toy 10 will bounce off the floor, onto the wall and back to you;

The toy may be shared with other players in a game of catch, by preferably allowing about five feet of distance between the players.

I claim:

1. A thrown, caught, and bounced toy, comprising:

(a) a cylindrical rod having a length to be conveniently gripped by at least one hand of a person, and to extend into respective interiors of specially formed high bounce balls; and (b) specially formed high bounce balls having respective interiors to fit over the respective ends of the cylindrical rod, wherein each interior of each specially formed high bounce ball has an overall entry profile, which is inclusive of both a radial circumferential surface and an interior inwardly tapered surface, thereby providing a clearance into which respective impact distorted portions of the high bounce balls freely move, to avoid their otherwise fatigue stressing, and thereby prolong their effective operating game life, as this toy is effectively used upon bouncing off of hard surfaces.

2. A thrown, caught, and bounced toy, as claimed in claim 1, having a padded gripping sleeve closely fitted about the cylindrical rod between the high bounce balls.

3. A thrown, caught, and bounced toy, as claimed in claim 2, wherein the padded gripping sleeve has the respective ends thereof formed on a radius, to provide a clearance at the juncture of these ends, and at respective entry profiles of the high bounce balls.

4. A thrown, caught, and bounced toy, as claimed in claim 3, wherein the high bounce balls are made from a heated and compressed synthetic rubber.

5. A thrown, caught, and bounced toy, as claimed in claim 4, wherein the padded gripping sleeve is an extruded polyvinyl chloride material.

6. A thrown, caught, and bounced toy, as claimed in claim 5, wherein the cylindrical rod is made from wood doweling.

7. A thrown, caught, and bounced toy, comprising:

(a) a cylindrical rod having a length to be conveniently gripped by at least one hand of a person, and to extend into respective interiors of specially formed high bounce balls;

(b) a padded gripping sleeve having the respective ends thereof formed on a radius, and being closely fitted about the cylindrical rod between high bounce balls; and (c) specially formed high bounce balls having respective interiors to fit over the respective ends of the cylindrical rod.

* * * * *